US009978581B2

(12) United States Patent
Kamahara

(10) Patent No.: US 9,978,581 B2
(45) Date of Patent: May 22, 2018

(54) LIGHTING DEVICE AND LIGHTING DEVICE MANUFACTURING METHOD

(71) Applicant: Masataka Kamahara, Kochi (JP)

(72) Inventor: Masataka Kamahara, Kochi (JP)

( * ) Notice: Subject to any disclaimer, the term of this patent is extended or adjusted under 35 U.S.C. 154(b) by 0 days. days.

(21) Appl. No.: 15/528,815

(22) PCT Filed: Mar. 24, 2015

(86) PCT No.: PCT/JP2015/001662
§ 371 (c)(1),
(2) Date: May 23, 2017

(87) PCT Pub. No.: WO2016/088283
PCT Pub. Date: Jun. 9, 2016

(65) Prior Publication Data

US 2017/0338095 A1 Nov. 23, 2017

(30) Foreign Application Priority Data

Dec. 2, 2014 (JP) ..... 2014-243826

(51) Int. Cl.
*H01J 63/06* (2006.01)
*H01J 9/22* (2006.01)
*H01J 63/02* (2006.01)

(52) U.S. Cl.
CPC ..... *H01J 63/06* (2013.01); *H01J 9/22* (2013.01); *H01J 63/02* (2013.01)

(58) Field of Classification Search
CPC ..... H01J 63/06; H01J 63/02; H01J 9/22
See application file for complete search history.

(56) References Cited

U.S. PATENT DOCUMENTS

| | | | | |
|---|---|---|---|---|
| 8,164,247 | B2 * | 4/2012 | Hirakawa | H01J 1/312 313/495 |
| 8,401,430 | B2 * | 3/2013 | Kanda | B82Y 10/00 399/168 |
| 2005/0134162 | A1 | 6/2005 | Hiraki | |
| 2010/0215402 | A1 | 8/2010 | Nagaoka et al. | |
| 2010/0320479 | A1 * | 12/2010 | Minato | H01L 33/505 257/88 |
| 2015/0069439 | A1 * | 3/2015 | Deeben | H01L 33/501 257/98 |

FOREIGN PATENT DOCUMENTS

| | | | |
|---|---|---|---|
| JP | 62-268042 | A | 11/1987 |
| JP | 11-162640 | A | 6/1999 |
| JP | 2005-071682 | A | 3/2005 |
| JP | 2006-190545 | A | 7/2006 |
| JP | 2008-010169 | A | 1/2008 |
| JP | 2010-267493 | A | 11/2010 |
| JP | 2012-142109 | A | 7/2012 |
| TW | M448782 | U | 3/2013 |

* cited by examiner

*Primary Examiner* — Anne Hines
(74) *Attorney, Agent, or Firm* — Norris McLaughlin & Marcus, P.A.

(57) ABSTRACT

A lighting device 1 has phosphors, a porous material (5), and emitters 4. The emitters are interposed between the phosphors and surfaces (2*a*) to be irradiated with light of the lighting device. The porous material has heat conductivity and is impregnated with the phosphors.

6 Claims, 6 Drawing Sheets

LIGHTING DEVICE AND LIGHTING DEVICE MANUFACTURING METHOD

TECHNICAL FIELD

This invention relates to a lighting device equipped with a luminous element using nanocarbon, examples of which may include diamond and carbon nanotube, and a method of manufacturing the lighting device. This invention more particularly relates to a lighting device configured to suppress the event that the luminous element ceases to emit light over a short time under temperature rising associated with high voltages, and a method of manufacturing the lighting device.

BACKGROUND

A broad range of light sources are available for artificial lighting, for example, incandescent bulbs, fluorescent bulbs, metal halide lamps, mercury lamps, and halogen lamps. These lighting devices, however, are in common in overconsumption of electricity, and such hazardous materials as mercury may involve the risk of environmental disruption. In fact, all of the artificial lighting devices currently used worldwide involve some kind of ecohazard in varying degrees, which leads to the prospect such artificial lighting devices historically available will eventually be banned from being used.

Under the circumstances, it is being said that alternatives to the existing artificial light sources; FEL (Field Emission Lamp, which in this description refers to lighting devices using luminous elements made of diamond), LED (Light Emitting Diode), and organic EL (Organic Electro Luminescence), will one day be conveniently used for different purposes that are suited to their advantages.

CITATION LIST

Patent Literature

Patent Literature 1 Japanese Patent Application Publication No. 2008-10169

SUMMARY OF THE INVENTION

Technical Problems

The LED and organic EL have been accepted and already spread throughout the society. In the meantime, the FEL was attracting attention as a potential high-luminance lighting means for the next generation. However, later studies revealed that the FEL had only one-month life cycle as a lighting device. Subsequent studies led to the success of prolonging the life cycle to three months, which is, however, the longest life cycle to date. This has stalled the FEL developments, leaving so far poor prospects for next-generation lighting devices that excel in luminance.

In light of the situation, this invention is directed to addressing the issues currently identified as origins of short life cycles of the FEL.

Technical Solutions

When the FEL is turned on, phosphors are subject to excessively high voltages to emit numerous electrons. Such high voltages elevate the temperatures of the phosphors, causing early breakage of the overheated phosphors and resulting shorter life cycles of the FEL. This invention, with a view to the fact that the temperature rising is the origin of early breakage of the phosphors, seeks to suppress the temperature rising by cooling the phosphors through heat convection, radiation, and conduction. Specifically, a lighting device according to this invention includes phosphors, a porous material, and an emitter. The emitter is interposed between the phosphors and surfaces to be irradiated with light of the lighting device. The porous material has heat conductivity and is impregnated with the phosphors. In the lighting device according to this invention thus characterized, heat generated in the phosphors is radiated out of the device through convection, radiation, and conduction. This technical advantage is further described in detail below.

While the lighting device (FEL) is turned on, heat generated in the phosphors is conducted outward through a material used with the phosphors. Therefore, the temperature rising of the phosphors may be effectively suppressed by selecting, as the material used, a material having good heat conductivity. For this purpose, the lighting device according to this invention includes, as the material used with the phosphors, a porous material having heat conductivity. The porous material is impregnated with the phosphors to suppress the temperature rising of the phosphors. Once the porous material with a large number of micropores is impregnated with the phosphors, a greater area of contact may be attainable between the phosphors and the porous material. Desirably, the porous material also has electrical conductivity.

The "porous" means having a large number of pores as in pumice stones. Examples of the porous material may include sintered porous compacts, green compacts, and mixtures of sintered porous compacts and green compacts, which can be obtained by, for example, powder metallurgy. Other method of producing such a porous material may include pelletizing a raw material of the porous material or a granulated or pulverized solid matter, and shaping a granulated or pulverized solid matter by molding casting. The casting mold technique ranges in different mold processes using water glass and furan resins as well as green sand described later (sand hardening). Any one of the available processes may be suitably selected as needed.

At the time of conducting heat generated in the phosphors to the porous material, heat conductivity improves with a grater area of contact between the phosphors and the porous material. This invention, therefore, provides a lighting device manufacturing method including: coating a surface of the porous material with phosphors; and impregnating the phosphors further into pores of the porous material. This may successfully increase the area of contact between the phosphors and the porous material.

When the lighting device is turned on over an extended period of time, more heat is conducted to the porous material. This elevates the temperature of the porous material, making it more difficult for heat generated in the phosphors to be conducted to the porous material.

In view of the issue described above, one may find it a solution to increase the mass of the porous material in order to effectively suppress the temperature rising of the phosphors and thereby reduce the risk of breakage of the phosphors. This may be rephrased that a greater mass of the porous material promises a longer life cycle of the FEL (lighting device). This solution, however, naturally has certain limits.

In the FEL (lighting device), the phosphors and the porous material are vacuum-sealed in a sealing body and can only be cooled through heat radiation. This invention, by leveraging heat convection by air, radiates and releases heat conducted from the phosphors to the porous material into the atmosphere. To this end, the lighting device disclosed herein is further equipped with a heat radiator partly adhered to the porous material and having at least one end exposed out of the sealing body.

In the lighting device according to this invention thus having the porous material exposed to the atmosphere via the heat radiator, heat generated in the phosphors may be transmitted to the porous material through heat conduction and further radiated from the porous material into the atmosphere via the heat radiator through heat radiation and convection. This may suppress over an extended period of time the temperature rising of the phosphors while the lighting device is turned on.

The lighting device is further characterized in that heat transmitted to the porous material in response to the temperature rising control of the phosphors is radiated and released into the atmosphere by air convection after the lighting device is turned off. The phosphors may accordingly cool down rapidly to an initial start-up temperature while the lighting device is turned off.

Effects of the Invention

The conventional lighting devices have the unsolved issue that the phosphors heated to higher temperatures cease to emit light over a short time. In the lighting device disclosed herein, on the other hand, the phosphors are attached the surface of the porous material and further impregnated into the porous material. This may provide a greater area of contact between the phosphors and the porous material, allowing heat generated in the phosphors during light emission to be conducted sooner to the porous material. The temperature rising of the phosphors may be accordingly suppressed, which may contribute to a prolonged life cycle of the phosphors.

In the conventional lighting devices, light emitted from the phosphors has to travel through voids between non-emitting ones of the phosphors, and the emitted light is attenuated while travelling through the void. In contrast, this invention may allow the whole light to reach surfaces of the lighting device. The lighting device according to this invention, therefore, improves in luminance as compared with the conventional lighting devices.

Further advantageously, the lighting device according to this invention may reduce the occurrence of bridging among the phosphors on the surface of the porous material, and may level out any irregularities on the surfaces of the phosphors. This may contribute to even higher luminance of the lighting device.

EMBODIMENTS OF THE INVENTION

First Embodiment

Figure 11:
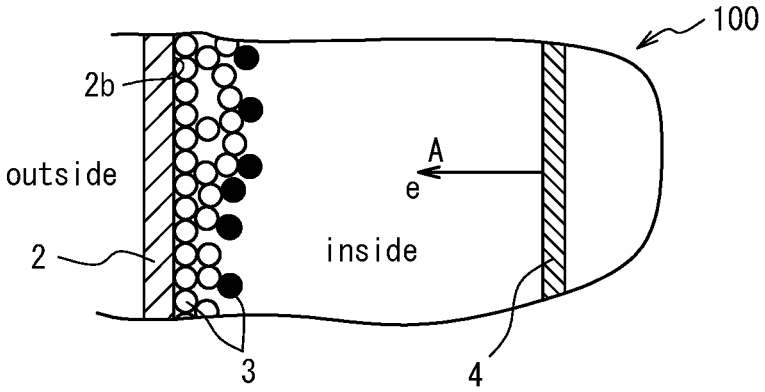
FIG. 11 is an enlarged sectional view of a principal part of a conventional FEL.

To start with, a conventional FEL (lighting device) 100 is described prior to embodiments of this invention. In the conventional FEL 100, an inner surface 2*b* of an external facing glass 2, i.e., a surface 2 to be irradiated with light, is coated with phosphors 3, as illustrated in FIG. 11. The phosphors 3 and the surface to be irradiated with light (external facing glass 2) are integrated with each other.

In the conventional FEL 100 thus structured, when electrons e jump out of emitters 4 toward the phosphors 4 in a direction indicated with arrow A and hit the phosphors 3, as illustrated in FIG. 11, light is emitted from the phosphors 3 hit by the electrons e alone. In the illustration of FIG. 11, it is the phosphors 3 indicated with black circles that are emitting light, whereas the ones indicated with unpainted circles are not emitting light.

In this structure, light emitted from the light-emitting phosphors 3 have no choice but to travel through voids between the non-emitting phosphors 3 before being radiated out of the FEL 100. Thus, light emitted from the phosphors 3 can only be radiated out of the FEL 100 through inter-grain voids of the phosphors 3 instead of passing through the phosphors 3. Then, the emitted light is mostly attenuated while travelling through the layers of the non-emitting phosphors 3. Needless to say, such a lighting device results in a poor luminous efficiency.

On the contrary, the FEL (lighting device) hereinafter described in detail in the embodiments of this invention is characterized in that the porous material impregnated with the phosphors is not integral with but is spaced away from surfaces of the FEL, i.e., surfaces to be irradiated with light.

Figure 1:
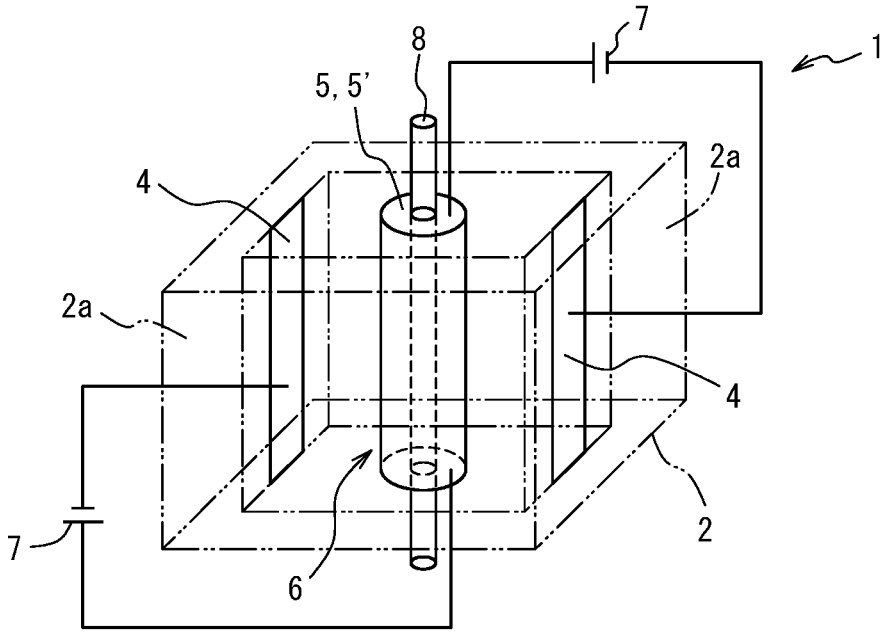
FIG. 1 is a perspective view, illustrating the schematic structure of an FEL (lighting device) according to a first embodiment of this invention.
Figure 2:
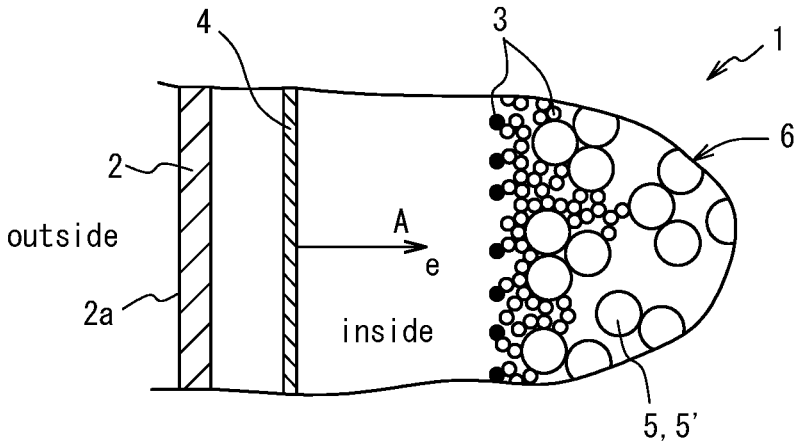
FIG. 2 is an enlarged view of a principal part of the FEL according to the first embodiment.

The FEL (lighting device) 1 according to a first embodiment of this invention, details of which are illustrated in FIGS. 1 and 2, has a sealing body 2, emitters 4, a luminous element 6, and a power source 7. As illustrated in FIG. 2, the luminous element 6 includes a porous material 5 having electrical conductivity and heat conductivity, and phosphors 3 that are impregnated into the porous material 5 thorough its surface. The emitters 4 are disposed so as to surround the luminous element 6. The emitters 4 and the luminous element 6 are housed in the sealing body 2. The sealing body 2 may include an airtight container. The surfaces of the sealing body 2, serving as surfaces 2*a* to be irradiated with light, are made of transparent glass. The luminous element 6 and the emitters 4 are vacuum-sealed in the sealing body 2. In the FEL 1 provided with these structural elements, the emitters 4 are interposed between the luminous element 6 and the surfaces to be irradiated 2*a* of the FEL 1; surfaces of the sealing body 2, so that the phosphors 3 are spaced away from the surfaces to be irradiated 2*a*.

Figure 3:
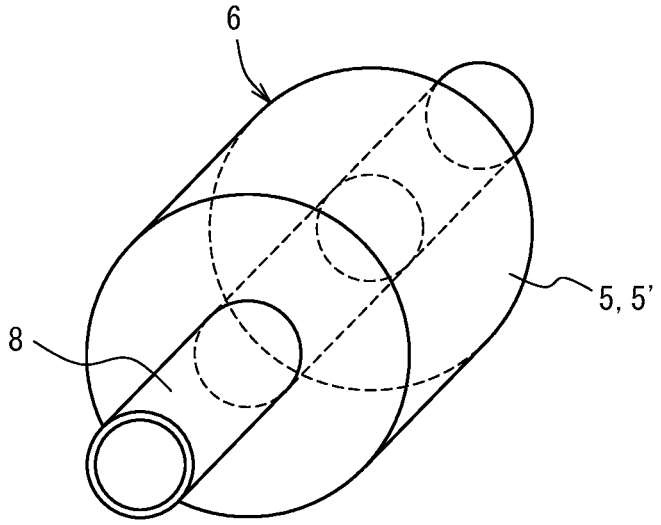
FIG. 3 is a perspective view of an example of the FEL according to the first embodiment mounted with a heat radiator.
Figure 4:
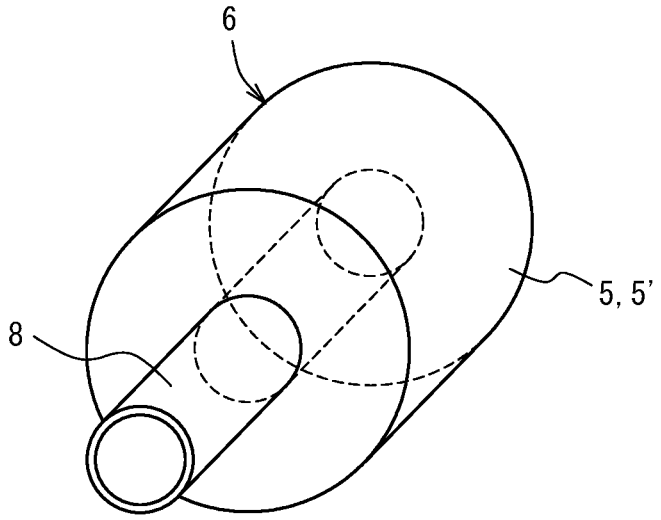
FIG. 4 is another perspective view of an example of the FEL according to the first embodiment mounted with the heat radiator.
Figure 5:
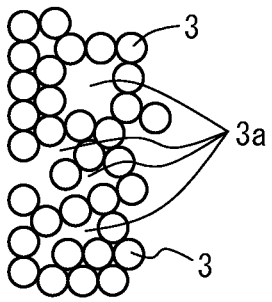
FIG. 5 is an enlarged sectional view of a principal part of the FEL, illustrating bridging among phosphors.

The FEL 1 further has a cylindrical heat radiator 8 for cooling purpose through air convection. The ends of the heat radiator 8 on its both sides protrude from the FEL 1 (specifically, sealing body 2). The both ends of the heat radiator 8 may protrude from the FEL 1 as illustrated in FIGS. 1 and 3, or only one of the ends of the heat radiator 8 may protrude from the FEL 1 as illustrated in FIG. 4. The structure illustrated in FIG. 4 requires the sealing of a gap between one of the protruding ends of the heat radiator 8 and between the FEL 1. This structural option, therefore, may reduce the sealing-related cost at the sacrifice of the cooling efficiency to a certain extent as compared with the structures of FIGS. 1 and 3.

The porous material 5 and the heat radiator 8 are coupled to each other, as illustrated in FIGS. 3 and 4. High voltages from the power source 7 are applied to the porous material 5. In case an electrically conductive material, such as a metal, is used for the heat radiator 8, therefore, an insulating material needs to be interposed between the heat radiator 8 and the porous material 5 subject to such high voltages. In this instance, it is necessary to conduct heat stored in the porous material 5 to the insulating material before conducting the heat to the heat radiator 8.

An insulating material, if interposed between the porous material 5 and the heat radiator 8, may degrade a cooling effect as compared with the use of an insulating material for the heat radiator 8 per se. Yet, it is not possible to use a resin, wood, or paper as the material of the heat radiator 8 because the production of the porous material 5 requires heating of the porous material 5 and the heat radiator 8 in a sintering furnace under a reducing atmosphere, and the porous material 5 and the heat radiator 8 are exposed to heat at high temperatures during the process to seal them.

The purpose of radiating heat generated in the phosphors 3 into the atmosphere via the porous material 5 and the heat radiator 8 may be served by providing the heat radiator 8 made of a material resistant to high-temperature heat during the sealing step. In case the heat radiator 8 is made of a non-insulating material having electrical conductivity like a metal, any associated problems may be avoided by interposing an insulating material that excels in heat conductivity between the heat radiator 8 and the porous material 5.

In the FEL 1 thus configured, light is emitted from the phosphors 3 hit by the electrons e jumping out of the emitters 4 toward the phosphors 3, as illustrated with arrow A in FIG. 2. In contrast to the conventional example illustrated in FIG. 11, the emitted light, without travelling through the inter-grain voids of the phosphors 3, may be directed straight toward the surfaces of the FEL 1 (surfaces 2*a* to be irradiated with light). Unlike the conventional example, the FEL 1 may successfully deliver the whole light to its surfaces and accordingly attain markedly higher luminance than the conventional example.

Hereinafter, a detailed description is given to a method of manufacturing the FEL 1 according to the embodiment using powder metallurgy, particularly to a method of manufacturing the porous material 5 and a method of manufacturing the luminous element 6 by impregnating the porous material 5 with the phosphors 3. The first step is to mix pulverized or granulated aluminum and dextrin having unoxidized surfaces. Dextrin is burnt and lost at temperatures lower by two-thirds than the melting point of aluminum (sintering temperature). When, for example, the porous material 5 is desirably obtained from a sintered compact having the porosity of 40%, 60% by volume of aluminum and 40% by volume of dextrin may be mixed.

The mixture thus prepared is put in a metal mold and pressed into a green compact. When the green compact desirably has the size of approximately 10 mm in diameter and 20 mm in length, the mixture may be subject to a load of approximately one ton.

The green compact thus obtained is put in a hydrogen gas reducing furnace and sintered at temperatures approximately lower by two-thirds than the melting point of aluminum. The retention time is approximately one hour per inch after the sintering temperature is reached. In case the green compact is approximately one inch in thickness, therefore, the retention time is set to one hour.

As a result of the steps described so far, the porous material 5 as the porous aluminum sintered compact is finally obtained. Then, dirt attached to the surface of the porous material 5 is removed by electropolishing or chemical polishing.

The porous material 5 thus obtained is immersed in a solution prepared by dissolving the phosphors 3 in a solvent including alcohol. The porous material 5 immersed in the solution is covered with a laminate of thin films made of a vinyl resin such as polyethylene, polyvinyl chloride, or polystyrene. Then, the surface of the porous material 5 is rubbed repeatedly with the laminate material to impregnate the porous material 5 with the phosphors 3 in the solution.

To have the phosphors 3 on the surface of the porous material 5 arranged on a straight line in parallel with the surface of the porous material 5, the laminate material is rubbed to level out any irregularities thereon with a soft and flat spatula made of a rubber. The laminate material is then removed, and the porous material 5 coated with the phosphors 3 is dried. Once the porous material 5 is dried, calcium phosphate is blasted onto the porous material 5 to harden and fix the phosphors 3 on the surface of the porous material 5.

As illustrated in FIG. 2, light is emitted from only some of the numerous phosphors 3 (phosphors 3 indicated with black circles). The luminance of the FEL 1 is expected to further improve with a larger number of light-emitting phosphors 3. This embodiment provides for the following technical features to increase the light-emitting phosphors 3.

As the phosphors 3 more deeply penetrate into the porous material 5 through its surface, the area of contact between the porous material 5 and the phosphors 3 may increase, conducting heat generated in the phosphors 3 more rapidly to the porous material 5. To this effect, the porous material 5 of the FEL 1 is deeply impregnated with the phosphors 3. Next, methods associated with the FEL 1 according to this embodiment are described; a method of impregnating the phosphors 3 as deeply as possible into the porous material 5, and a method of increasing the light-emitting phosphors 3.

As described earlier, the conventional FEL 100 should reduce the non-emitting phosphors 3 that block emitted light in order to improve the luminous efficiency, so that as much light emitted from the phosphors 3 as possible may arrive at the surfaces of the FEL 100 (surfaces to be irradiated with light). In the conventional FEL 100, therefore, inter-grain voids of the phosphors 3 are desirably greater, and the occurrence of bridging desirably increases among layers of the grains of the phosphors 3. The bridging means voids 3*a* resulting from interactions among the grains of the phosphors 3

In the FEL 1 according to this embodiment, on the other hand, essentially none of the phosphors 3 blocks light emitted from the phosphors 3, making it unnecessary to set the before-mentioned conditions to improve the luminous efficiency. The FEL 1 is aimed at improving heat conductivity by reducing sizes of the inter-grain voids of the phosphors 3 to decrease heat generated from the phosphors 3 and thereby attain a prolonged life cycle. This technical advantage is hereinafter described.

Figure 6:
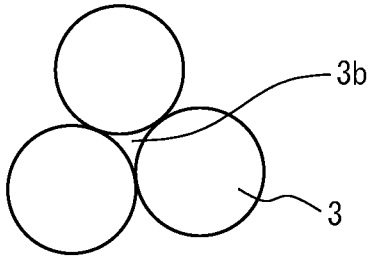
FIG. 6 is an enlarged sectional view of the principal part of the FEL illustrated to describe optimal phosphors.
Figure 7:
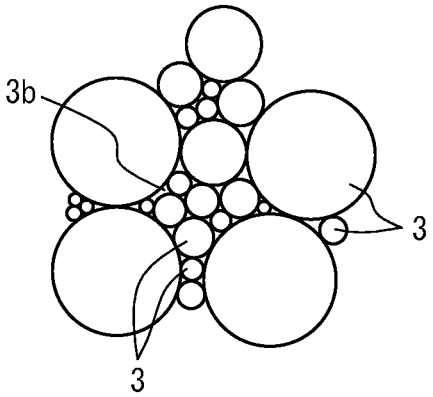
FIG. 7 is another enlarged sectional view of the principal part of the FEL illustrated to describe optimal phosphors.

In case the porous material 5 is impregnated with the phosphors 3 substantially equal in grain size, with a very narrow distribution of grain sizes, relatively large voids 3*b* are present among the grains of the phosphors 3, as illustrated in FIG. 6. In case the porous material 5 is impregnated with the phosphors 3 with broadly distributed grain sizes, smaller phosphors 3 progress into voids among larger phosphors 3, and the voids 3*b* become smaller, as illustrated in FIG. 7. Thus, a larger grain size distribution may result in smaller voids 3*b*, while a total area of contact in the whole phosphors 3 may increase. As a result, the heat conductivity may be improved.

In the FEL 1, therefore, a broader grain size distribution of the phosphors 3 may evidently contribute to improvements of the heat conductivity. In general, the phosphors 3 with better grain fluidity and filling efficiency may penetrate more easily into the porous material 5.

This embodiment described so far selecting, with a focus on physical properties, the phosphors 3 that can conduce to a longer life cycle through improvements of heat conductivity between the phosphors 3 and the porous material 5.

In the FEL 1 according to this embodiment, heat conductivity between the phosphors 3 and the porous material 5 may be improved by optimally selecting the physical properties of the phosphors 3. The FEL 1 may also improve the heat conductivity between the phosphors 3 and the porous material 5 by physically pushing the phosphors 3 into the porous material 5 (under pressure)

In this embodiment, the phosphors 3 are pushed into the porous material 5 by the use of a laminate of thin films made of a vinyl resin. In case the laminate material used to push the phosphors 3 into the porous material 5 is harder than the porous material 5, the surface of the porous material 5 may be damaged. To avoid that, the laminate material is preferably lower in hardness than the porous material 5.

To be specific, the porous material 5 is immersed in a solvent in which the phosphors 3 are dissolved and rubbed with a relative strong force using the laminate material lower in hardness than the porous material 5 to push the phosphors 3 of the solvent into the porous material 5.

Figure 8:
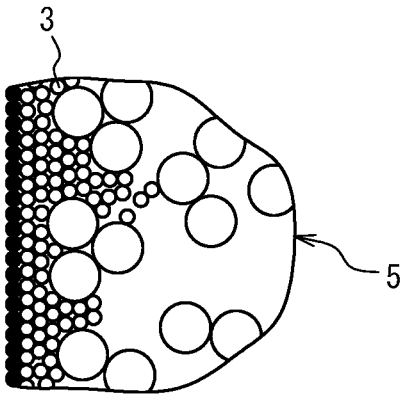
FIG. 8 is an enlarged sectional view of a principal part of the FEL illustrating a method of manufacturing the FEL according to the first embodiment.

The phosphors 3 may be most effectively pushed into the porous material 5 as described below. With the porous material 5 being immersed in a solvent in which the phosphors 3 are dissolved, the surface of the porous material 5 is rubbed repeatedly by the use of a laminate of thin films made of a vinyl resin such as polyethylene, polyvinyl chloride, or polystyrene so as to impregnate the phosphors 3 into the porous material 5. After any irregularities of the laminate material in contact with the porous material 5 are leveled out, the laminate material is removed from the porous material 5. In this manner, the phosphors 3 may be forced into the pores of the porous material 5, and the bridging among the phosphors 3 may be less likely to occur on the surface of the porous material 5, as illustrated in FIG. 8. Besides that, any irregularities on the surfaces of the phosphors 3 may be leveled out. The FEL 1 according to this embodiment described so far may successfully improve the heat conductivity between the phosphors 3 and the porous material 5, thereby achieving higher luminance than that of the conventional FEL 100.

Second Embodiment

Since the lighting device according to this invention is neither a machine nor construction, a degree of strength required of the porous material 5 should only be large enough to withstand falls from heights of a few meters. In that sense, the porous material of the lighting device according to this invention may be obtained from a green compact produced by pressing aluminum in a metal mold, instead of a sintered compact. A porous material 5' obtained from such a green compact may impart a required strength to the lighting device. Specifically, the porous material 5' obtained from an aluminum green compact pressed by applying thereto the pressure of 1 ton/80 $mm^2$ may have a degree of strength large enough to avoid breakage when dropped from heights of a few meters.

When the porous material 5' obtained from such a green compact, it is unnecessary to mix a material used to form pores, such as dextrin, with the raw material of the porous material 5' (aluminum).

The porous material 5', green compact solely consisting of aluminum, desirably has a narrower grain size distribution, because a large distribution may cause fine grains to progress into voids among coarse grains. This may invite finer grains to progress into voids present among the fine grains and leave voids between the finer grains, further inviting even finer grains to progress into the voids. This event, if occurs throughout the porous material, the porous material may be overly stuffed with the grains, resulting in an unduly high density. To avoid that, this embodiment uses, as the porous material 5', an aluminum green compact having a narrow grain size distribution.

In this embodiment that manufactures the porous material 5' by pressing, instead of sintering, a green compact without using any additional pore-formation material such as dextrin, production costs may be significantly reduced.

In the first embodiment, a sintered compact is used to obtain the porous material 5. On the other hand, a green compact is used to obtain the porous material 5' according to the second embodiment. This invention may include other alternatives of the porous material 5, an example of which is a mixture of a sintered compact and a green compact. In another example of the porous material 5, a green compact is sintered but is exposed to the sintering temperature for a shorter period of time to attain a degree of strength somewhat higher than that of the green compact. The porous material thus obtained has a sintered surface, with the green compact still remaining inside.

Third Embodiment

The FEL 1 according to the first embodiment illustrated in FIG. 1 has two emitters 4 and accordingly has two light-emitting positions. In theory, the emitters are preferably disposed at more positions, for example, three or five positions, in order to improve the luminous efficiency by increasing the light-emitting positions. In practice, a greater number of emitters 4 may only increase the chance of more light being blocked by the emitters 4, reducing an amount of light finally radiated out of the FEL 1. Thus, the amount of emitted light and the amount of blocked light are contrary to each other.

Figure 9:
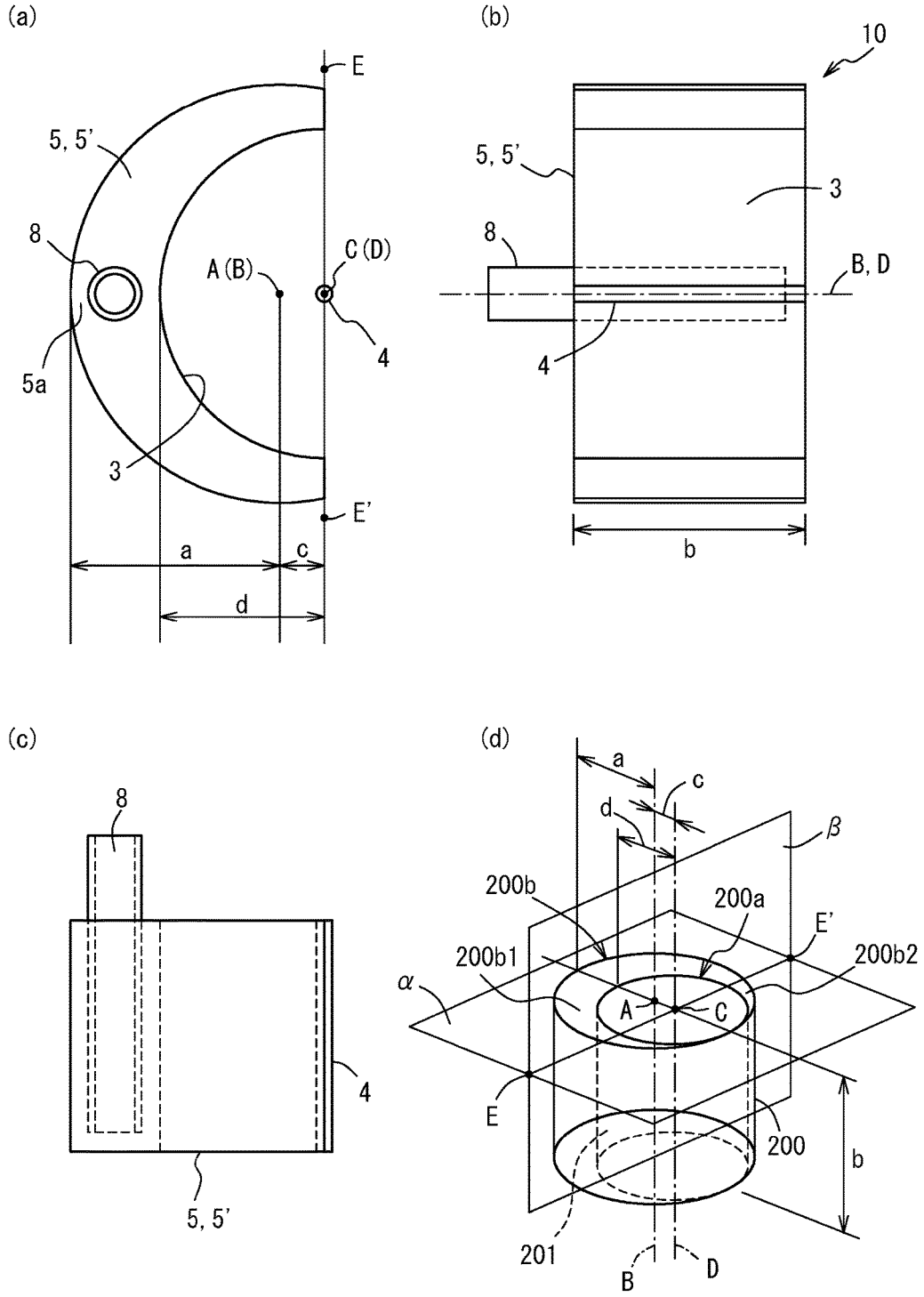
FIGS. 9 (*a*), 9 (*b*), and 9 (*c*) are respectively a plan view, a front view, and a side view of an FEL according to a third embodiment of this invention, and FIG. 9 (*d*) is a perspective view, illustrating a production process.

This issued is addressed by an FEL 10 according to this embodiment illustrated in FIGS. 9 (*a*) to 9 (*d*). The FEL 10 has a porous material 5 shaped as described below. Referring to FIG. 9 (*d*), a first columnar body 200, a second columnar body 201, and a second plane β are defined. The first columnar body 200 has a radius a, an axial length b, and an axis B passing through a point A on an optional first plane α and orthogonal to the first plane α. The second columnar body 201 has a radius d (d=a c) and an axis D parallel to the axis B and passing through a point C on the first plane α away by a distance c from the point A. The second plane β is orthogonal to the first plane α and includes a line segment E-E' orthogonal to a linear segment A-C on the first plane α.

After the first and second columnar bodies 200 and 201 and the first and second planes α and β are defined, the first columnar body 200 is divided into an inner body 200*a* including the second columnar body 201 and an outer body 200*b* not including the second columnar body 201. Then, the inner body 200*a* alone is removed from the first columnar body 200, with the outer body 200*b* being left unremoved. The outer body 200*b* is then divided along the second plane β into a first body 200*b*1 and a second body 200*b*2, and the second body 200*b*2 is removed from the outer body 200*b*, with the first body 200*b*1 on the axis-B side being left unremoved.

Thus, a porous material 5 is produced that has a contour shaped equally to the first body 200*b*1 left unremoved. Then, a surface of the porous material 5 is impregnated with the phosphors 3, and one end of the cylindrical heat radiator 8 is embedded in a thickest portion of the porous material 5. The heat radiator 8 is disposed in parallel with the axes B and D, with the other end of the heat radiator 8 being exposed out of the porous material 5. A linear emitter 4 is prepared by coating a piano wire with diamond and disposed along the axis D.

In the FEL 10 according to this embodiment thus characterized, the linear emitter 4, a piano wire coated with diamond or nanocarbon such as carbon nanotube, alone blocks light emitted from the phosphors 3. With this structural feature, light emitted from the phosphors 3 in the whole inner curved surface of the porous material 5 facing the emitter 4 may be successfully guided out of the FEL 10.

Fourth Embodiment

Figure 10:
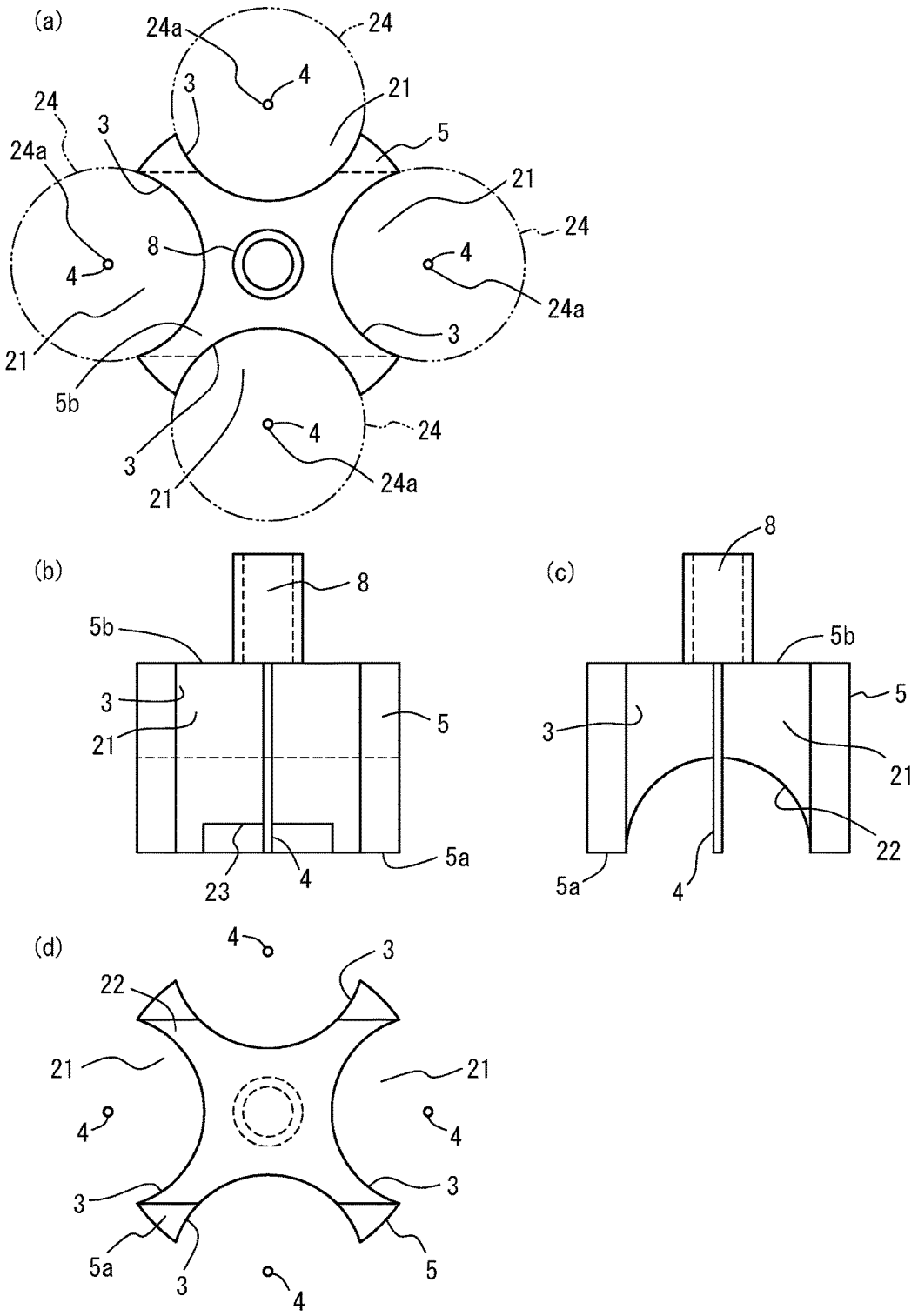
FIGS. 10 (*a*), 10 (*b*), 10 (*c*) and 10(*d*) are respectively a plan view, a front view, a side view, and a perspective view of an FEL according to a fourth embodiment of this invention.

An FEL 20 illustrated in FIGS. 10 (*a*) to 10 (*d*) is obtained by improving the FELs of the first to third embodiments so as to emit light in multiple directions like light bulbs.

The FEL 20 has a porous material 5 having a columnar shape. The porous material 5 has cutouts 21 in four regions on its circumferential surface. The cutouts 21 each have the shape of a curved surface and are formed at ends of the porous material 5 in two diametrical directions opposite to and orthogonal to each other. The cutouts 21 extend along the axis of the columnar shape of the porous material 5. The porous material 5 further has cutouts 22 and 23 on one end 5*a* thereof. The cutout 22 has an arch-shaped inner end, and the cutout 23 has a flat-shaped inner end. The inner surfaces of the cutouts of the porous material 5 are impregnated with the phosphors 3. The cutouts 21 each have an emitter 4 that is a diamond-coated piano wire. On the circumferential surfaces of columnar regions removed from the porous material 5 by forming the cutouts 21, the emitters 4 are disposed at circumferentially central positions in parallel with the axis of the porous material 5. In other words, the emitters 4 are disposed at centers 24*a* of circles 24 including the cutouts 21.

At the other end 5*b* of the porous material 5 is the cylindrical heat radiator 8. The heat radiator 8 is disposed on and along the axis of the porous material 5. One end of the heat radiator 8 is embedded in the porous material 5, while the other end thereof is exposed from the other end 5*b*.

Thus structured, the circumferential surfaces of the porous material 5 provided with the cutouts 21 receive light emitted from the associated emitters 4, allowing light to be radiated in multiple directions like light bulbs.

This invention was described thus far by way of the exemplified embodiments. The porous material 5 according to this invention is not necessarily limited to metal green compacts or sintered compacts. The porous material 5 may be manufactured by first to third methods described below. To manufacture the porous material 5, the first method molds a material having porosity, such as diatomaceous earth or pumice stone, in any one of shapes illustrated in FIGS. 1, 3, 4, 9, and 10, and the phosphors are applied to the molded product and further penetrated into its pores.

The second method manufactures the porous material 5 as described below. One of a pulverized solid material, a granulated solid material, and a mixture of the pulverized and granulated materials is mixed with bentonite and dextrin or an adhesive. The prepared mixture is pelletized and molded into a porous pellet having an adequate size. The molded porous pellet is formed in any one of shapes illustrated in FIGS. 1, 3, 4, 9, and 10 and coated with the phosphors. Then, the phosphors are penetrated into pores of the molded porous pellet.

The third method is a modified example of the second method. The second method prepares the porous pellet, an intermediate product, from the mixture and then molds the porous pellet to obtain a final molded product. The third method, by leveraging greensand casting, obtains a final molded product without preparing such a porous pellet (intermediate product). A mixture similar to the mixture used in the second method is further mixed with 8.5 to 9.0% by weight of bentonite, 0.2 to 0.3% by weight of dextrin, and 3.5 to 4.0% by weight of water and kneaded to impart viscosity to the mixture. The viscous mixture is then molded in a desired shape in a wooden pattern or a metal mold illustrated in FIGS. 1, 3, 4, 9, and 10, and then dried and hardened into a molded product. The steps of the third method that follow; coating the molded product with the phosphors, and penetrating the phosphors into pores of the molded product to obtain the porous material 5, are the same as the second method. Other casting methods may be usable that employ water glass or furan resins instead of green sand (sand hardening). One may choose any suitable one from the available methods as needed.

The embodiments described thus far are non-limiting examples of this invention. The embodiments may be modified or optionally selected as needed within the scope and spirit of this invention.

REFERENCE SIGNS LIST

1 FEL
2 sealing body
2*a* surface to be irradiated (with light)
2*b* inner surface
3 phosphor
3*a* void (bridging)
3*b* void
4 emitter
5 porous material
5' porous material
5*a* one end
6 luminous element
7 power source
8 heat radiator
10 FEL

20 FEL
21 cutout
22 cutout
23 cutout
24 circle
24*a* center of circle

The invention claimed is:

1. A lighting device, comprising:

phosphors;

a porous material; and an emitter, wherein the emitter is interposed between the phosphors and a surface to be irradiated with light of the lighting device, and the porous material has heat conductivity and is impregnated with the phosphors.

2. The lighting device as claimed in claim 1, wherein the porous material further has electrical conductivity.

3. The lighting device as claimed in claim 1, wherein the porous material is one selected from a sintered compact, a green compact, a mixture of a sintered compact and a green compact, a porous material, a material obtained by pelletizing a raw material of a pulverized or granulated solid matter, and a pulverized or granulated solid matter shaped by casting.

4. The lighting device as claimed in claim 1, further comprising a sealing body for vacuum-seal of the porous material and the emitter, the sealing body comprising the surface to be irradiated with light.

5. The lighting device as claimed in claim 4, further comprising a heat radiator that radiates heat of the phosphors, wherein the heat radiator is partly adhered to the porous material and has at least one end exposed out of the sealing body.

6. A lighting device manufacturing method, comprising steps of:

manufacturing a porous material having heat conductivity; and impregnating a surface of the porous material with phosphors, wherein the step of impregnating the surface of the porous material with the phosphors comprises:

coating the surface of the porous material with the phosphors;

pushing the phosphors on the surface into the porous material using a material lower in hardness than the porous material;

leveling out irregularities of the material used after the phosphors are pushed into the porous material; and removing the material used from the porous material.

* * * * *